US009822675B2

(12) United States Patent
Jeon et al.

(10) Patent No.: US 9,822,675 B2
(45) Date of Patent: Nov. 21, 2017

(54) VALVE OPENING AND CLOSING APPARATUS

(71) Applicant: HYUNDAI MOTOR COMPANY, Seoul (KR)

(72) Inventors: Jae Hee Jeon, Hwaseong-si (KR); Min Hui Yu, Hwaseong-si (KR); You Sang Son, Suwon-si (KR); Seock Joong Yoon, Hanam-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 59 days.

(21) Appl. No.: 14/942,399

(22) Filed: Nov. 16, 2015

(65) Prior Publication Data

US 2017/0030231 A1 Feb. 2, 2017

(30) Foreign Application Priority Data

Jul. 29, 2015 (KR) ..... 10-2015-0107569

(51) Int. Cl.

| | |
|---|---|
| ***F01L 13/00*** | (2006.01) |
| ***F01L 1/18*** | (2006.01) |
| ***F01L 1/20*** | (2006.01) |
| ***F01L 1/26*** | (2006.01) |
| ***F01L 9/02*** | (2006.01) |

(52) U.S. Cl.

CPC ..... *F01L 13/0026* (2013.01); *F01L 1/181* (2013.01); *F01L 1/267* (2013.01); *F01L 9/025* (2013.01); *F01L 1/20* (2013.01); *F01L 2105/00* (2013.01)

(58) Field of Classification Search

CPC ..... F01L 13/0026; F01L 1/181; F01L 1/20; F01L 1/267; F01L 9/025; F01L 2105/00

USPC ..... 123/90.16, 90.15

See application file for complete search history.

(56) References Cited

U.S. PATENT DOCUMENTS

| | | | | |
|---|---|---|---|---|
| 6,382,151 | B2 * | 5/2002 | Pierik | F01L 13/0063 123/90.16 |
| 7,168,403 | B2 * | 1/2007 | Fujita | F01L 1/08 123/90.15 |
| 9,097,145 | B2 * | 8/2015 | Hwang | F01L 1/185 |

FOREIGN PATENT DOCUMENTS

| | | |
|---|---|---|
| JP | S53-044715 | 4/1978 |
| JP | S622-199913 | 9/1987 |
| JP | 2004-293632 | 10/2004 |
| JP | 2010-521622 | 6/2010 |
| KR | 10-1998-0076672 | 11/1998 |

* cited by examiner

*Primary Examiner* — Mark Laurenzi
*Assistant Examiner* — Paul Thiede
(74) *Attorney, Agent, or Firm* — Brinks Gilson & Lione

(57) ABSTRACT

A valve opening and closing apparatus includes a rocker arm which is in contact with a cam and causes a valve to be opened and closed using rotation of the cam. In particular, the valve opening and closing apparatus includes an eccentricity-creating unit which is disposed on the rocker arm and changes an eccentric position using rotation. A contact-maintaining unit of the valve opening and closing apparatus is disposed between the rocker arm and the eccentricity-creating unit so as to maintain the contact between the cam and the rocker arm when the cam is rotating.

12 Claims, 5 Drawing Sheets

"PRIOR ART"

VALVE OPENING AND CLOSING APPARATUS

CROSS REFERENCE TO RELATED APPLICATION

The present application claims the benefit of the Korean Patent Application No. 10-2015-0107569, filed Jul. 29, 2015, which is incorporated herein by reference in its entirety.

FIELD

The present disclosure generally relates to a cap and a locker arm that open and close a valve via which air is supplied to a cylinder, and more particularly to a mechanical valve opening and closing apparatus able to adjust a point in time to open a valve.

BACKGROUND

The statements in this section merely provide background information related to the present disclosure and may not constitute prior art.

Typically, when an engine is operating, both air and fuel are supplied to a combustion chamber of a cylinder. Fuel is injected by an injector, while air is supplied to the combustion chamber through the operation of a cam and a valve provided in the cylinder head. At this time, it is required to adjust a point in time to open the valve or the amount of the opening of the valve depending on the operation area of the engine. In order to blow air taken in by the cam and the valve into the combustion chamber, the valve disposed on the upper surface of the combustion chamber is opened and closed by the cam using a hydraulic circuit.

FIG. 1 illustrates a valve opening and closing apparatus of the related art. The valve opening and closing apparatus controls a point in time to open a valve 10 using a cam 20 and the amount of the opening of the valve 10 using a hydraulic circuit. We have discovered that since the hydraulic circuit is composed of a plurality of parts, such as a pump unit 30, a high-pressure chamber 40, an accumulator 50, a deaerator 60, a pressure chamber 70, a check valve 80, a solenoid valve 90, and a brake unit 95, the hydraulic circuit increases the complexity, weight, and cost of the valve opening and closing apparatus. In addition, when a pressure-forming closed circuit has a large volume, the response of a hydraulic system becomes slow, degrading performance.

In addition, when the response of the hydraulic system is delayed, jumping occurs, i.e. a nose 21 of the cam is instantaneously separated from the pump unit 30 (or a rocker arm). In this case, accumulated impact fatigue causes an endurance problem, such as cam-fitting or damage to the pump unit 30.

Therefore, we have discovered that a valve opening and closing apparatus having a simplified configuration and a superior response rate, able to adjust the point in time to open a valve and the amount of the opening of the valve by means of cams, is required. This apparatus is also required to enable the cams to stay in continuous contact with contact members while rotating.

SUMMARY

The present disclosure provides a valve opening and closing apparatus having a simplified configuration and a superior response rate, the valve opening and closing apparatus being able to adjust the point in time to open a valve and the amount of the opening of the valve by means of cams, and being able to provide the cams to stay in continuous contact with contact members while rotating.

According to one aspect of the present disclosure, a valve opening and closing apparatus includes: a rocker arm in contact with a cam, wherein the rocker arm causes a valve to be opened and closed using rotation of the cam; an eccentricity-creating unit disposed on the rocker arm, wherein the eccentricity-creating unit changes an eccentric position upon rotation of a rotary shaft; and a contact-maintaining unit disposed between the rocker arm and the eccentricity-creating unit, wherein the contact-maintaining unit causes the cam and the rocker arm to stay in contact with each other when the cam is rotating.

The eccentricity-creating unit may include: eccentric cams rotatably disposed in the rocker arm; and a rotary shaft eccentrically coupled to the eccentric cams. An eccentric position of the eccentric cams is adjusted following the rotation of the rotary shaft, thereby adjusting a degree to which the cams contact the corresponding rocker arm.

The rotary shaft may extend through the rocker arm, and support lugs protruding in a longitudinal direction of the rotary shaft may be disposed on both sides of the rotary shaft, and the contact-maintaining unit may be connected to the rotary shaft and the support lugs.

The contact-maintaining unit may be implemented as an elastic member.

The contact-maintaining unit may further include a spacer disposed outside the rotary shaft.

A rotary member may extend through and is coupled to one end portion of the corresponding rocker arm. A pressing part may be provided on the other end portion of the corresponding rocker arm such that the valve is to be pressed by the pressing part.

The contact-maintaining unit may maintain the cam and the rotary member in constant contact with each other.

The rocker arm may include: a body to which the eccentric cams are coupled; and an actuating part pressing the valve when pressed by the body. The body and the actuating part are coupled to each other by means of the rotary shaft of the actuating unit extending therethrough.

The body may include a front section, a rear section, and a connecting section, the front section and the rear section being symmetrical to each other. Each of the front section and the rear section has a through-hole in a central portion to which a corresponding eccentric cam of the eccentric cams is coupled. Each of the front section and the rear section has a coupling hole in one portion in one portion and a pressing portion on the other portion. The support lugs are positioned between the through-hole and the coupling hole. The pressing portion extends sideways from above the through-hole.

The actuating part may have a rotation hole in one portion thereof, through which the rotary shaft extends, and an extension on the other portion thereof, extending sideways from above the rotation hole. The pressing part is provided on the extension. The support lugs are positioned on the extension.

The body may have through-holes in central portions to which the eccentric cams are coupled, coupling holes and the support lugs in predetermined portions, and pressing portions on the other portions. The actuating part may have a rotation hole in one portion and an extension on the other portion, the pressing part being provided on the extension. The body and the actuating part may be coupled to each other by means of the rotary shaft extending through the rotation hole. The pressing part may press the valve in response to the pressing portions pressing support lugs of the extension.

The actuating part may have a bearing on a portion of the actuating part corresponding to the rotary shaft.

Each of the eccentric cams may have a bearing coupled to an outer circumference thereof.

According to the valve opening and closing apparatus as described above, unlike the related art in which the cam is mainly used to adjust the point in time at which the valve is to be opened and the amount of the opening of the valve, the eccentricity-creating unit having a simple configuration is provided on the rocker arm, such that the point in time at which the valve is to be opened and the amount of the opening of the valve can be precisely controlled depending on the operating ranges of the engine.

In particular, since a hydraulic circuit having a complicated configuration can be omitted, the valve opening and closing apparatus has a simplified configuration and is reduced in weight and the number of components, thereby obtaining the effects of optimized fuel efficiency and reduced costs. In addition, since the valve opening and closing apparatus operates mechanically, the response rate thereof is improved compared to a hydraulic mechanism. Accordingly, the valve opening and closing apparatus has improved performance at low torque due to the improved response rate.

In addition, the contact-maintaining unit enables the cam and the rotary member to constantly stay in rolling contact with each other, thereby preventing jumping. This can consequently remove an endurance problem, such as cam-fitting or damage to the rotary member that would otherwise be caused by accumulated impact fatigue.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
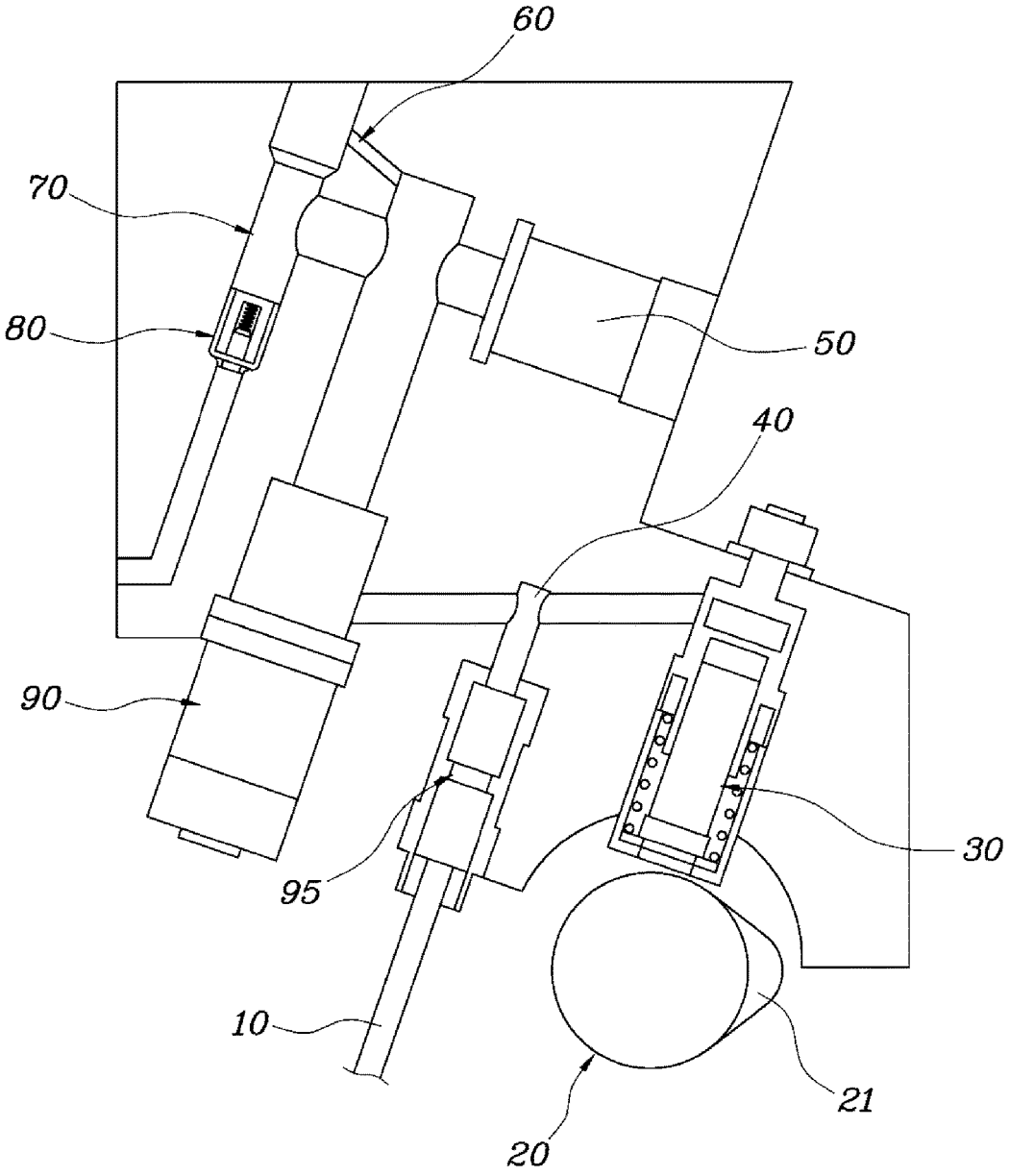
FIG. 1 illustrates a valve opening and closing apparatus of the related art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
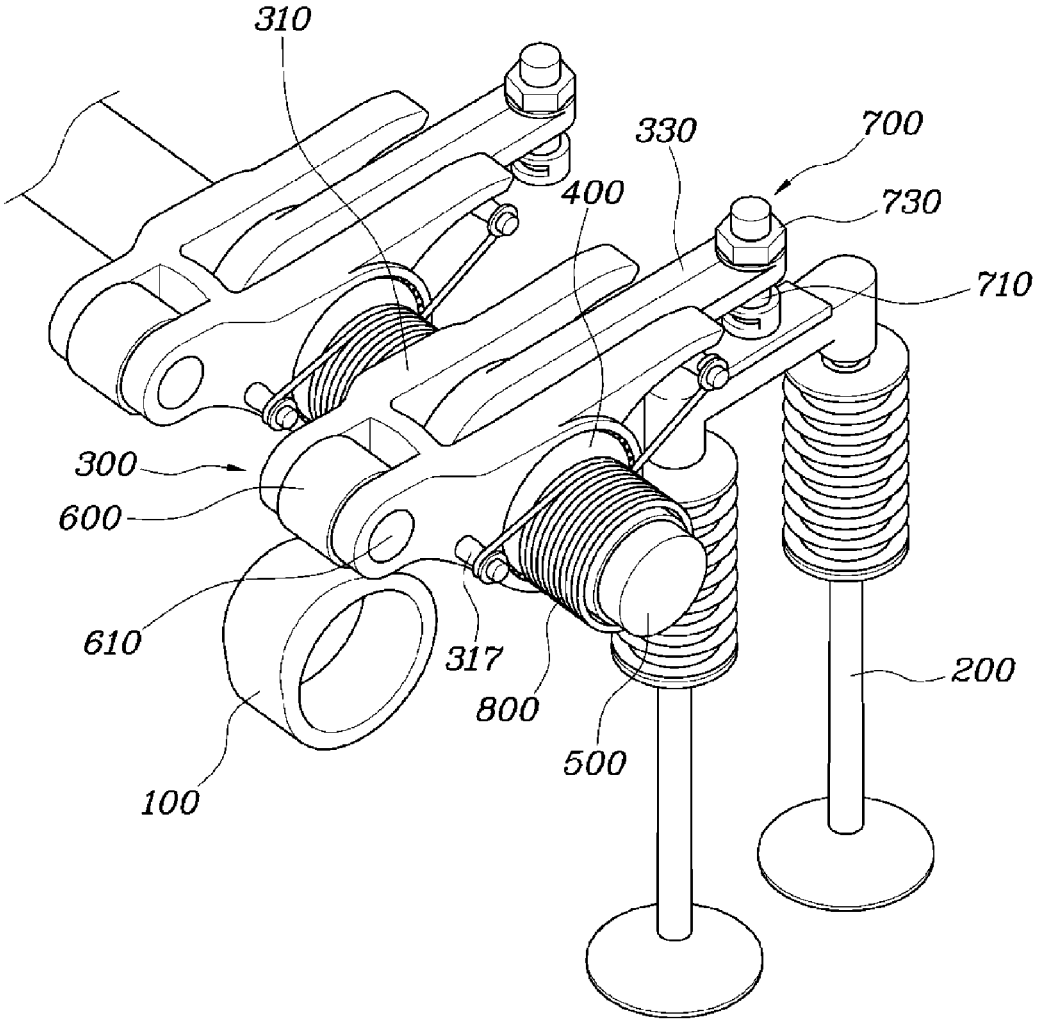
FIG. 2 is a perspective view illustrating a valve opening and closing apparatus according to an exemplary embodiment of the present disclosure.
Figure 3:
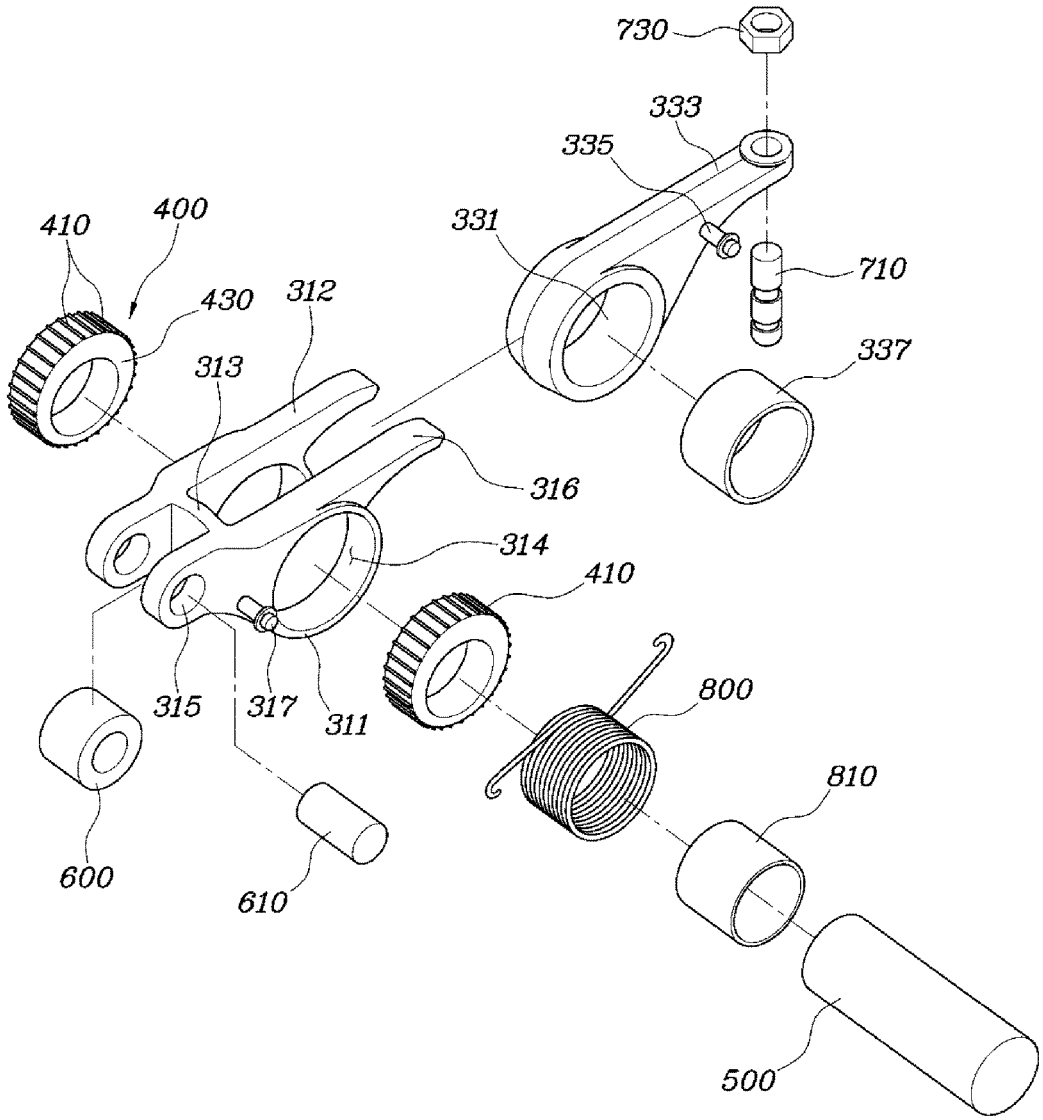
FIG. 3 is an exploded perspective view illustrating a rocker arm in FIG. 2.

As illustrated in FIGS. 2 and 3, the valve opening and closing apparatus according to the exemplary embodiment of the present disclosure includes a rocker arm 300, an eccentricity-creating unit 400 and 500, and a contact-maintaining unit 800. The rocker arm 300 is in contact with a cam 100, allowing a valve 200 to be opened and closed through the rotation of the cam 100. The eccentricity-creating unit 400 and 500 is provided on the rocker arm 300, and changes an eccentric position 430 upon rotation of the eccentricity-creating unit 400 and 500. The contact-maintaining unit 800 is disposed between the rocker arm 300 and the eccentricity-creating unit 400 and 500, and causes the cam 100 and the rocker arm 300 to stay in contact with each other when the cam 100 is rotating. In addition, the eccentricity-creating unit 400 and 500 includes eccentric cams 400 and the rotary shaft 500, respectively. The eccentric cams 400 are rotatably disposed in the rocker arm 300, and the rotary shaft 500 is eccentrically coupled to the eccentric cams 400. In addition, the rotary shaft 500 extends through the rocker arm 300, and support lugs 317 and 335 protruding in the longitudinal direction of the rotary shaft 500 are disposed on both sides of the rotary shaft 500. The contact-maintaining unit 800 is connected to the rotary shaft 500 and the support lugs 317 and 335. With this configuration, the eccentric position 430 of the eccentric cams 400 can be adjusted following the rotation of the rotary shaft 500, thereby adjusting the degree to which the cams 100 contact the corresponding rocker arm 300. The cam 100 and the rocker arm 300 are elastically supported by the contact-maintaining unit 800 such that the cam 100 and the rocker arm 300 continuously stay in contact with each other.

A rotary member 600 extends through and is coupled to one end portion of the rocker arm 300 via a pin 610, and a pressing part 700 is provided on the other end portion of the rocker arm 300. The rotary member 600 may be implemented as a roller. A point in time at which the valve 200 is opened and the amount of the opening of the valve 200 are determined by the correlation between the rotary member 600 and the cam 100, i.e. depending on the distance set between the center of the cam 100 and the center of the pin 610, which is the center of rotation of the rotary member 600. In addition, the contact-maintaining unit 800 maintains the cam 100 and the rotary member 600 in a constant contact position by providing elastic force to the rocker arm 300 and the rotary member 600. Therefore, the contact-maintaining unit 800 enables the cam and the rotary member to be constantly in rolling friction, thereby preventing jumping. This can remove an endurance problem, such as cam-fitting or damage to the rotary member that would otherwise be caused by accumulated impact fatigue.

The contact-maintaining unit 800 may be implemented as an elastic member and, more particularly, a coil spring or a leaf spring. In addition, a spacer 810 disposed outside the rotary shaft 500 may be further provided between the elastic member 800 and the rotary shaft 500. The spacer 810 may be selectively applied.

Therefore, according to the present disclosure, the point in time at which the valve 200 is opened and the amount of the opening of the valve 200 are variably controlled by adjusting the distance in the center between the cam 100 and the pin 610 by changing the eccentric position 430 in response to the rotation of the rotary shaft of the eccentricity-creating unit 400 and 500. Since the pressing part 700 may be integrally formed on the corresponding rocker arm 300, the pressing part 700 may be implemented as a screw or the like. According to the present disclosure, the pressing part 700 is illustrated as including a screw 710 and a fastening member 730 such that the point in time at which the valve 200 is opened and the amount of the opening of the valve 200 can be more precisely adjusted once again using the pressing part 700. The fastening member 730 is implemented as a nut, such that the screw 710 can be adjusted by the nut 730.

A displacement of the locker arm 300 is changed by the cam 100 in a related-art valve opening and closing apparatus. In response to the changed displacement, the locker arm 300 presses against or releases pressure from the valve 200, such that the valve 200 is opened or closed. Unlike the related-art valve opening and closing apparatus mainly using the cam in order to change a point in time to open or close the valve, according to the present disclosure, the locker arm 300 is provided with the eccentricity-creating unit 400 and 500, such that the point in time at which the valve 200 is opened and the amount of the opening of the valve 200 can be can be mechanically varied using a simple configuration.

In addition, the eccentricity-creating unit 400 and 500 may be provided on a rocker arm having a typical configuration, such that the eccentric position 430 can be adjusted through the rotation of the rotary shaft 500, thereby variably adjusting the point in time at which the valve 200 is opened and the amount of the opening of the valve 200. The rocker arm 300 will be illustrated and described as having a body 310 and an actuating part 330.

As illustrated in FIGS. 2 and 3, the rocker arm 300 includes the body 310 to which the eccentric cams 400 are coupled and the actuating part 330 opening the valve 200 when pressed by the body 310. The body 310 and the actuating part 330 are coupled to each other by means of the rotary shaft 500 extending therethrough. When the rotary shaft 500 rotates, the eccentric cams 400 rotate following the rotation of the rotary shaft 500, changing the eccentric position 430. This consequently changes the position in which the rocker arm 300 contacts the cam 100, thereby adjusting the point in time at which the valve 200 is opened and the amount of the opening of the valve 200.

The body 310 of the rocker arm 300 includes a front section 311, a rear section 312, and a connecting section 313. The front section 311 and the rear section 312 are formed symmetrical to each other, and a through-hole 314 is formed in each of the front section 311 and the rear section 312. Each of the front section 311 and the rear section 312 may be a plate having a predetermined thickness, which is substantially inverted triangle shaped. The front section 311 and the rear section 312 having the above-described configuration are maintained at a predetermined distance from each other by the connecting section 313 disposed between a pair of through-holes 314 and a pair of coupling holes 315 formed in predetermined portions of the body 310. The eccentric cams 400 are coupled to the through-holes 314. The support lug 317 is positioned between the through-holes 314 and the coupling holes 315 of the front section 311. In addition, the body 310 has pressing portions 316 provided on the other portions thereof, extending sideways from above the through-holes 314. The rotary member 600 is coupled to the coupling holes 315 via the pin 610, such that the rotary member 600 can transfer the rotating force of the cam 100 to the rocker arm 300 while rotatably supporting the cam 100.

In addition, the actuating part 330 has a rotation hole 331 in one portion thereof. The diameter of the rotation hole corresponds to the outer diameter of the rotary shaft 500, such that the rotary shaft 500 extends through the rotation hole 331. Thus, a bearing 337 can be provided in the portion of the rotation hole 331 corresponding to the rotary shaft 500. The bearing 337 enables the rotary shaft 500 to smoothly move within the rotation hole 331. Although the bearing 337 may be omitted when the rotation hole 331 is formed of aluminum (Al), the bearing 337 may not be omitted when the rocker arm 300 is formed of cast iron or forged iron.

An extension 333 is provided on the other portion of the actuating part 330, extending sideways from above the rotation hole 331. The pressing part 700 is provided on the extension 333. The extension 333 has the support lugs 335 on predetermined positions thereof. In particular, the support lugs 335 are formed in position corresponding to the pressing portions 316 of the body 335. At the moment that one end of the contact-maintaining unit 800 is coupled thereto, the pressing portions 316 press the support lugs 335, whereby the actuating part 330 is actuated to press the valve 200. As illustrated in the drawings, the support lugs 335 may be integrally formed on the actuating part 330 by molding, shaping, or the like. Alternatively, the support lugs 335 may be formed as separate pieces and subsequently coupled to a hole or recesses (not shown) formed in the rocker arm 300.

When the coupling relationship between the body 310 and the actuating part 330 is described in summary, the front section 311 and the rear section of the body 312 are maintained at a predetermined distance from each other, and the eccentric cams 400 are coupled to the through-holes 314 formed in the front and rear sections 311 and 312. Bearings 410 may be coupled to the outer circumference of the eccentric cams 400 for smoother relative rotation of the eccentric cams 400. The bearings 410 may be needle bearings, which are disposed at predetermined distances along the outer circumference of the eccentric cams 400. On the other hand, like the bearings 337, the bearings 410 of the eccentric cams 400 may be omitted depending on the environment or the design.

After the actuating part 330 is fitted between the front section 311 and the rear section 312, the rotary shaft 500 sequentially extends through and is fitted into the eccentric cam 400 in the front section 311, the rotation hole 331 of the actuating part 330, and the eccentric cam 400 in the rear section 312. Therefore, when the rotary shaft 500 rotates, the eccentric cams 400 rotate, changing the eccentric position 430, whereby the position at which the rocker arm 300 contacts the cam 100 is changed. With this arrangement, when the position at which the rocker arm 300 contacts the cam 100 is changed, the support lugs 335 of the actuating part 330 are pressed by the pressing portions 316 of the body 310, thereby pressing the valve 200. In this manner, the point in time at which the valve 200 is opened and the amount of the opening of the valve 200 can be adjusted.

In addition, after one end of the contact-maintaining unit 800 is coupled to the support lug 317 disposed on the front section 311 and subsequently is wound on the rotary shaft 500, the other end of the contact-maintaining unit 800 is coupled to the support lug 335 disposed on the extension 333. With this configuration, the body and the actuating part of the rocker arm 300 are elastically supported, whereby the rotary member 600 can stay in elastic contact with the cam.

Although not illustrated in this disclosure, the rotary shaft 500 may be driven by a driving part (not shown) controlled by a controller (not shown). However, a person skilled in the art can make many modifications or alterations to this configuration without departing from the scope of the present disclosure.

An operation in response to eccentric variable control by the valve opening and closing apparatus will be described in greater detail with reference to FIGS. 4 and 5.

Figure 4:
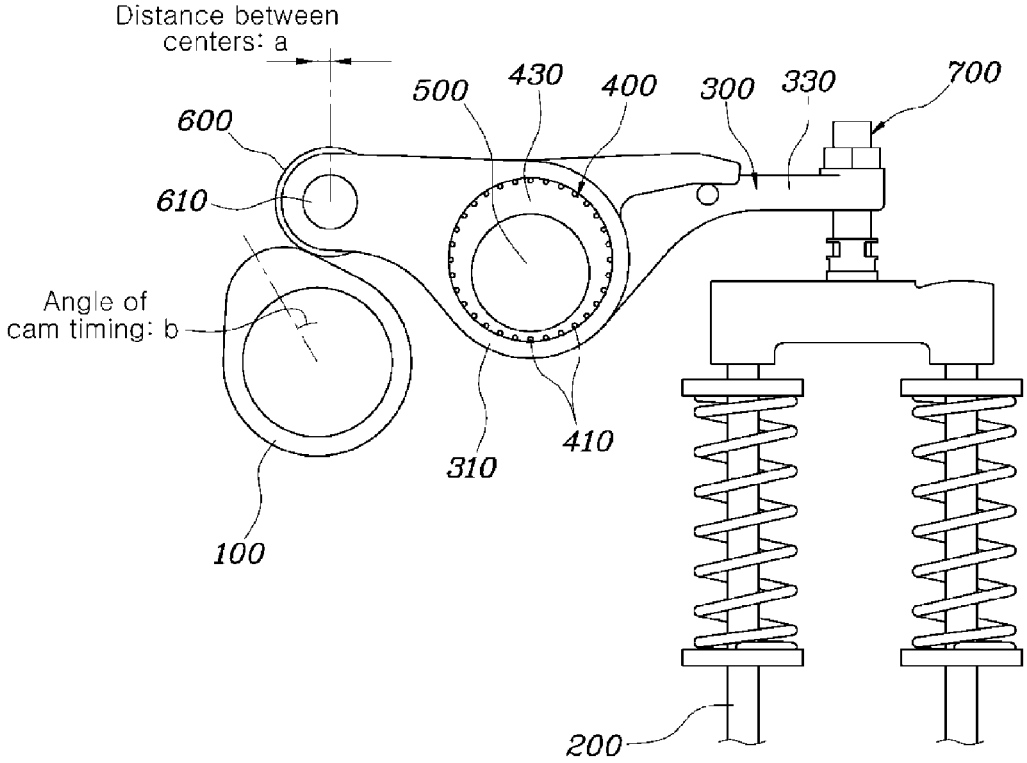
FIG. 4 illustrates a variable control-off state.

FIG. 4 illustrates a variable control-off state, in which eccentricity is not created in the rocker arm 300 since the eccentric position 430 formed by the eccentric cams 400 and the rotary shaft 500 are positioned at top points. For the operation of opening and closing the valve 200, the distance from the center of the cam 100 to the center of the pin 610 of the rotary member 600 is set to "a" and the angle of timing at which the cam 100 opens and closes the valve 200 is set to "b".

Figure 5:
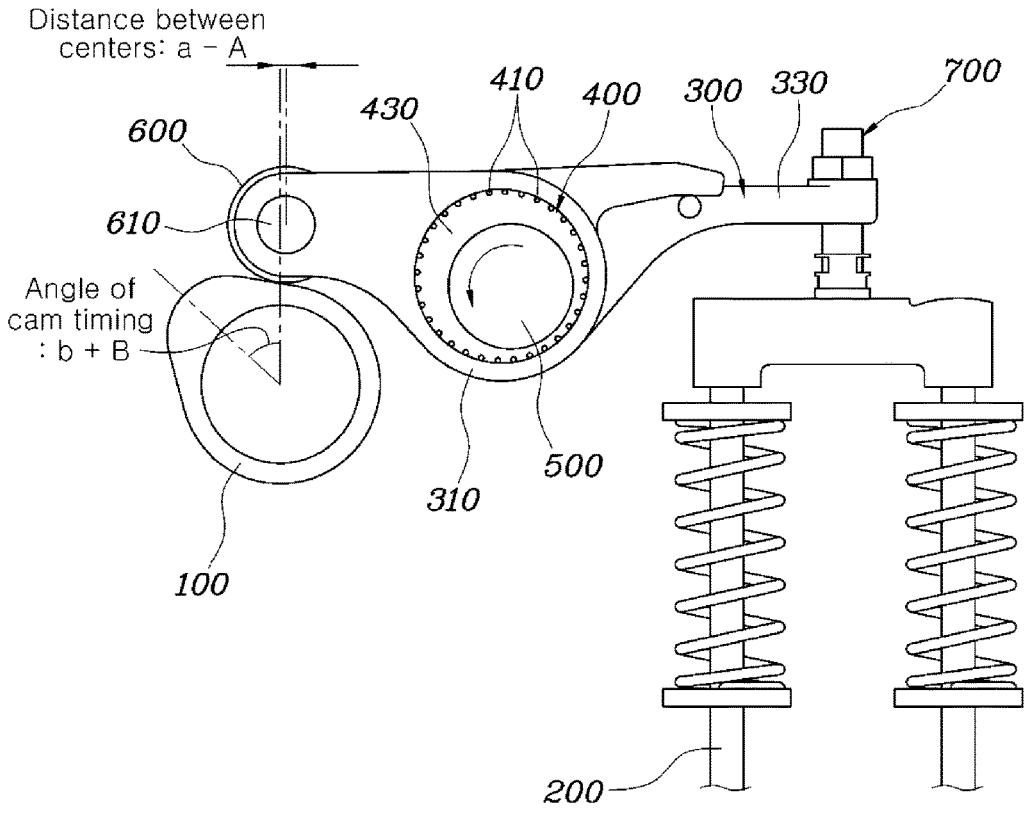
FIG. 5 illustrates a variable control-on state.

FIG. 5 illustrates a variable control-on state, in which the eccentric position 430 is moved toward the cam 100 due to the rotation of the rotary shaft 500 in the counterclockwise direction indicated by an arrow. A camshaft (not shown), the center of the rotation of the cam 100, and the rotary shaft 500 of the eccentricity-creating unit 400 and 500 are fixed to an engine. Since the eccentric position 430 is displaced due to the rotation of the eccentric cams 400 caused by the rotary shaft 500, eccentricity occurs in the rocker arm 300. The rocker arm 300 is pressed in the direction of the top-left part on the paper surface, and is brought into closer contact with the cam 100. Consequently, the distance between the center of the cam 100 and the center of the pin 610 of the rotary member 600 is set to "a-A", which is reduced from the distance in the variable control-off state, and the angle of timing at which the cam 100 opens and closes the valve 200 is set to an increased value of "b+B", such that the valve 200 is opened at an earlier point in time.

Thus, when the angle of timing at which the cam 100 opens and closes the valve 200 is increased as in FIG. 5, the valve 200 is opened at the earlier point in time, whereby a point in time at which air starts to be taken in becomes earlier. At this time, the position at which the pressing part 700 contacts the valve 200 moves in an oblique direction, i.e. toward the top-left part, whereby the amount of the opening of the valve 200 can also be increased. Accordingly, when the engine is in a high-speed operation area or a low and medium-speed operation area, it is possible to carry out the above-described control operation such that the valve 200 is opened at an earlier point in time and the amount of the opening increases.

When the engine is in a low-speed operation area, the eccentric position 430 is controlled to be in a low-right position by rotating the rotary shaft 500 in the clockwise direction. Consequently, the timing in which the valve 200 is opened is delayed, and the amount of the opening of the valve 200 is reduced.

As described above, the valve opening and closing apparatus can mechanically vary the eccentric position 430 using the eccentricity-creating unit 400 and 500 having a simple configuration without using a complicated part, such as a hydraulic circuit. It is therefore possible to set the point in time at which the valve is to be opened and the amount of the opening of the valve according to driving states, based on the cam profiles of the operating ranges of the engine, thereby more precisely controlling the engine.

Unlike the related art in which the cam is mainly used to adjust the point in time at which the valve is to be opened and the amount of the opening of the valve, according to the valve opening and closing apparatus as described above, the eccentricity-creating unit having a simple configuration is provided on the rocker arm, such that the point in time at which the valve is to be opened and the amount of the opening of the valve can be precisely controlled depending on the operating ranges of the engine.

In particular, since a hydraulic circuit having a complicated configuration can be omitted, the valve opening and closing apparatus has a simplified configuration and the weight and the number of components thereof are reduced, thereby obtaining the improved fuel efficiency and reduced costs. In addition, since the valve opening and closing apparatus operates mechanically, the response rate thereof is improved compared to a hydraulic mechanism. Accordingly, the valve opening and closing apparatus has improved performance in low torque due to the improved response rate.

In addition, the contact-maintaining unit enables the cam and the rotary member to constantly stay in rolling contact with each other, thereby preventing jumping. This can remove an endurance problem, such as cam-fitting or damage to the rotary member that would otherwise be caused by accumulated impact fatigue.

Although the exemplary embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A valve opening and closing apparatus for an engine comprising:

a rocker arm in contact with a cam, the rocker arm configured to open and close a valve upon a rotation of the cam;

an eccentricity-creating unit disposed on the rocker arm, the eccentricity-creating unit configured to change an eccentric position upon a rotation of a rotary shaft of the eccentricity-creating unit; and a contact-maintaining unit disposed external to the rocker arm, wherein the contact-maintaining unit is configured to maintain a contact between the cam and the rocker arm when the cam is rotating, wherein the eccentricity-creating unit comprises eccentric cams rotatably disposed in the rocker arm, and a rotary shaft eccentrically coupled to the eccentric cams, and wherein the rotary shaft extends through the rocker arm, support lugs protruding from the rocker arm in a longitudinal direction of the rotary shaft are disposed in parallel to the rotary shaft on both sides of the rotary shaft, and the contact-maintaining unit is connected to the rotary shaft and the support lugs.

2. The valve opening and closing apparatus according to claim 1, wherein an eccentric position of the eccentric cams is adjusted upon the rotation of the rotary shaft, thereby adjusting a degree to which the eccentric cams contact the corresponding rocker arm.

3. The valve opening and closing apparatus according to claim 2, wherein each of the eccentric cams has a bearing coupled to an outer circumference thereof.

4. The valve opening and closing apparatus according to claim 1, wherein the contact-maintaining unit comprises an elastic member.

5. The valve opening and closing apparatus according to claim 4, wherein a rotary member extends through and is coupled to an end portion of the corresponding rocker arm, and a pressing part configured to press the valve is provided on other end portion of the corresponding rocker arm.

6. The valve opening and closing apparatus according to claim 5, wherein the contact-maintaining unit maintains the cam and the rotary member in constant contact with each other.

7. The valve opening and closing apparatus according to claim 1, wherein the contact-maintaining unit further comprises a spacer disposed upon the rotary shaft.

8. The valve opening and closing apparatus according to claim 1, wherein the rocker arm comprises:

a body to which the eccentric cams are coupled; and an actuating part pressing the valve when pressed by the body, wherein the body and the actuating part are coupled to each other by the rotary shaft of the eccentricity-creating unit.

9. The valve opening and closing apparatus according to claim 8, wherein the body comprises a front section, a rear section, and a connecting section, the front section and the rear section being symmetrical to each other, wherein each of the front section and the rear section comprises a through-hole to which a corresponding eccentric cam of the eccentric cams is coupled, and each of the front section and the rear section further comprises a coupling hole to which a rotary member is coupled to transfer a rotation force of the cam, and wherein at least one of the support lugs is positioned between the through-hole and the coupling hole, and each of the front section and the rear section comprises a pressing portion, above the through-hole, extended from a center portion of the body toward the valve.

10. The valve opening and closing apparatus according to claim 8, wherein the actuating part comprises a rotation hole through which the rotary shaft is inserted, and an extension extending above the rotation hole toward the valve, wherein a pressing part is formed in the extension, and at least one of the support lugs is positioned on the extension.

11. The valve opening and closing apparatus according to claim 8, wherein the body comprises:

through-holes in central portions to which the eccentric cams are coupled;

coupling holes;

the support lugs in predetermined portions, and pressing portions on other portions, wherein the actuating part has a rotation hole in one portion and an extension on other portion, a pressing part being provided on the extension, wherein the body and the actuating part are coupled to each other by the rotary shaft of the eccentricity-creating unit extending through the rotation hole, and wherein the pressing part presses the valve in response to the pressing portions pressing the support lugs of the extension.

12. The valve opening and closing apparatus according to claim 8, wherein the actuating part includes a bearing on a portion of the actuating part corresponding to the rotary shaft of the eccentricity-creating unit.

* * * * *